US006382475B1

(12) United States Patent
Weikinger

(10) Patent No.: US 6,382,475 B1
(45) Date of Patent: May 7, 2002

(54) POURING DEVICE FOR A CANISTER-TYPE CONTAINER

(75) Inventor: Peter Weikinger, Wels (AT)

(73) Assignee: "Pack-Pro"Kunstostoff- und Metallverpackungs GmbH, Steinhaus (AT)

( * ) Notice: Subject to any disclaimer, the term of this patent is extended or adjusted under 35 U.S.C. 154(b) by 0 days.

(21) Appl. No.: 09/936,652

(22) PCT Filed: Mar. 9, 2000

(86) PCT No.: PCT/AT00/00059

§ 371 Date: Sep. 14, 2001

§ 102(e) Date: Sep. 14, 2001

(87) PCT Pub. No.: WO00/55059

PCT Pub. Date: Sep. 21, 2000

(30) Foreign Application Priority Data

Mar. 15, 1999 (AT) ..... 454/99

(51) Int. Cl.[7] ..... B67D 3/00
(52) U.S. Cl. ..... 222/479; 222/481.5
(58) Field of Search ..... 222/468, 479, 222/564, 465.1, 484

(56) References Cited

U.S. PATENT DOCUMENTS

| | | | | |
|---|---|---|---|---|
| 1,676,711 A | | 7/1928 | Reap | |
| 3,901,417 A | * | 8/1975 | Schiemann | 222/479 |
| 4,412,633 A | * | 11/1983 | Guerrazzi et al. | 222/468 |
| 4,509,665 A | | 4/1985 | Goodall | |
| 4,781,313 A | | 11/1988 | Verheyen | |
| 5,273,466 A | | 12/1993 | Thompson | |

FOREIGN PATENT DOCUMENTS

| | | |
|---|---|---|
| AT | 323 002 | 6/1975 |
| DE | 1 930 906 | 2/1971 |
| DE | 20 20 558 | 12/1971 |
| DE | 21 13 000 | 9/1972 |
| DE | 2 153 155 | 5/1973 |
| DE | 196 15 906 | 8/1997 |
| DE | 297 20 426 | 5/1998 |
| FR | 2 134 285 | 12/1972 |
| GB | 204 893 | 10/1923 |

* cited by examiner

*Primary Examiner*—Philippe Derakshani
(74) *Attorney, Agent, or Firm*—Collard & Roe, P.C.

(57) ABSTRACT

A pouring device for a canister-shaped container (1) having a pouring spout (4) which can be sealed by a sealing cap (6) is described which receives a retaining ring (7) for an aeration pipe (8) running at least approximately parallel to the retaining ring (7), which is set thereon in the upper peripheral section of the retaining ring (7) relative to the pouring position. In order to create advantageous pouring conditions it is proposed that the aeration pipe (8) is sealed at its end (9) averted from the retaining ring (7) and in the vicinity of its upper peripheral section in the pouring position exhibits at least one through opening (10) terminating in the container (1) having a smaller through cross-section than the internal pipe cross-section.

6 Claims, 2 Drawing Sheets

POURING DEVICE FOR A CANISTER-TYPE CONTAINER

CROSS REFERENCE TO RELATED APPLICATIONS

Figure 2:
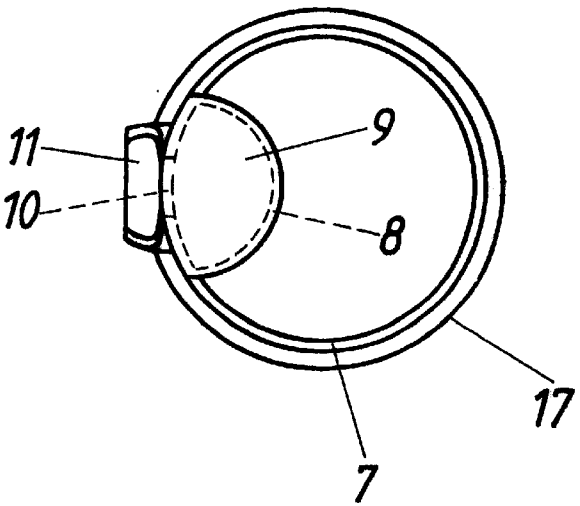

Applicants claims priority under 35 U.S.C. §119 of Austrian Application No. A 454/99, filed on Mar. 15, 1999. Applicant also claims priority under 35 U.S.C. §120 of PCT/AT00/00059, filed on Mar. 9, 2000. The international application under PCT article 21(2) was not published in English.

TECHNICAL FIELD

The present invention relates to a pouring device for a canister-shaped container having a pouring spout which can be sealed by a sealing cap and which receives a retaining ring for an aeration pipe running at least approximately parallel to the retaining ring, which is set thereon in the upper peripheral section of the retaining ring relative to the pouring position.

PRIOR ART

If the fluid stream flowing out of the pouring opening of an otherwise closed container blocks the air intake an increasing subpressure builds up in the container on account of the decreasing volume of fluid, which, on reaching a certain magnitude, results in air breaking through the pouring opening and thus equalises the pressure, with the result that a subpressure again builds up in the container and the procedure is repeated. The pressure fluctuations in the container give rise to an irregular gushing pouring stream in cooperation with the air bubbles sucked in through the pouring opening, which not only has a disadvantageous effect on the emptying rate, but also makes it difficult to accurately direct the pouring stream relative to a filling aperture, for example. For steadying the pouring stream various pouring devices have already been put forward, common to which is the fact that an aeration pipe running parallel to the axis of the pouring spout is provided, which is set in the pouring spout of the container by means of a retaining ring such that it is located in the upper peripheral section of the pouring spout in the pouring position so that air can enter the container through this aeration pipe and effect pressure equalisation. But since the preferably short aeration pipe is in the vicinity of the fluid stream and is impacted thereby, any steadying of the pouring stream attained with such a pouring device remains unsatisfactory in canister-shaped containers in particular.

In order to avoid a suction effect of the pouring stream hindering air intake into the container it has already been proposed (DE 297 20 426 U1) to insert a pipe socket running at an oblique angle into the pouring spout of the container, which presents at least one intake aperture in the upper peripheral section relative to the pouring position, which is shielded by a front wall of the pipe socket relative to the fluid flow. This wall separates an air pocket out from the fluid stream by the pipe socket in the vicinity of the through opening, which facilitates air entry into the container through the through opening in the pipe socket. Despite this measure the resulting pouring stream may be uneven if the air intake to the air pocket is hindered by the pouring flow. Similar difficulties can also occur with another known pouring device (DE 196 15 906 A1), wherein an aeration pipe running transversely to the axis of the pouring spout is arranged at an axial distance to the pouring spout on a retaining ring set in the pouring spout and exhibits a protective wall in the vicinity of the air intake opening relative to the fluid flow, because again the air intake to the air pocket formed by the protective wall can be impaired by the pouring stream.

DESCRIPTION OF THE INVENTION

The object of the invention therefore is to develop a pouring device for canister-shaped containers of the type initially outlines such that the container can be continuously emptied with an even flow.

The invention solves this task by the fact that the aeration pipe is closed at its end averted from the retaining ring and in the vicinity of its upper peripheral section in the pouring position exhibits at least one through opening terminating in the container having a smaller through cross-section than the internal pipe cross-section.

Since the aeration pipe set on the retaining ring extends in the vicinity of the pouring spout the air intake into this aeration pipe cannot be hindered for an extended period by the pouring stream leaving the pouring spout; at the same time this aeration pipe is closed at its end averted from the retaining ring and therefore cannot be impacted by the fluid flow. Aeration of the container required for pressure equalisation can thus be effected advantageously via the through opening of the aeration pipe, which is provided on the side averted from the pouring stream in an upper peripheral section of the aeration pipe relative to the pouring position. Since the internal pipe cross-section is greater than the through cross-section of the through opening, there is always an adequate air supply inside the aeration pipe for even metered aeration of the container to be guaranteed via the through opening in the sleeve of the aeration pipe.

Particularly advantageous aeration ratios result when on the outer periphery of the aeration pipe on the side of the through opening facing the retaining ring a deflecting baffle is provided thereon partially enclosing the former, which supports even passage of air through the through opening into the container. This deflecting baffle needs to project only slightly over the outer periphery of the aeration pipe to be able to have a corresponding influence on the air guidance. For this reason axial introduction of the aeration pipe into the pouring spout of the container is not hindered by this deflecting baffle, in particular if the deflecting baffle falls away towards the close end of the aeration pipe. In addition, the aeration pipe can be inclined slightly inwards towards the axis of the retaining ring to enable coaxial introduction of the retaining ring with the aeration pipe into the pouring spout of the container in spite of the deflecting baffle projecting outwards from the aeration pipe.

The pouring procedure can also be improved by the fact that at least one more through opening having a smaller through cross-section is provided between the through opening arranged in the vicinity of the sealed end of the aeration pipe and the pouring spout of the container. This additional through opening allows finer air bubbles to enter the container, thus supporting the desired even pressure equalisation.

Because the aeration pipe has to be provided on the upper peripheral side of the pouring spout determined by the pouring position, a corresponding built-in position of the retaining ring is to be provided in the pouring spout of the container. For this purpose a rotating safety device formed by limit stops, which provides the proper rotary position of the retaining ring in the pouring spout of the container when the pouring device is being mounted, can be formed between the retaining ring and the pouring spout of the container, if the retaining ring is introduced to the pouring spout using a rotary motion, for example. Such mounting of the pouring device can be undertaken in particularly simple fashion if the sealing cap forms an assembly unit with the retaining ring bearing the aeration pipe able to be inserted positively into the sealing cap. In this case only the aeration pipe is to be guided over the sealing cap into the pouring spout such that the sealing cap can be set on the pouring spout. When the pouring spout of the container is sealed by the sealing cap the retaining ring is pressed as a seal into the pouring spout, whereby the rotary displacement of the retaining ring as far as the limit stop of the rotating safety device forces the proper fitting position of the pouring spout when screw caps are used. When the sealing cap is removed the retaining ring remains in the pouring spout of the container as a result of its press fit.

BRIEF DESCRIPTION OF THE DIAGRAMS

Figure 1:
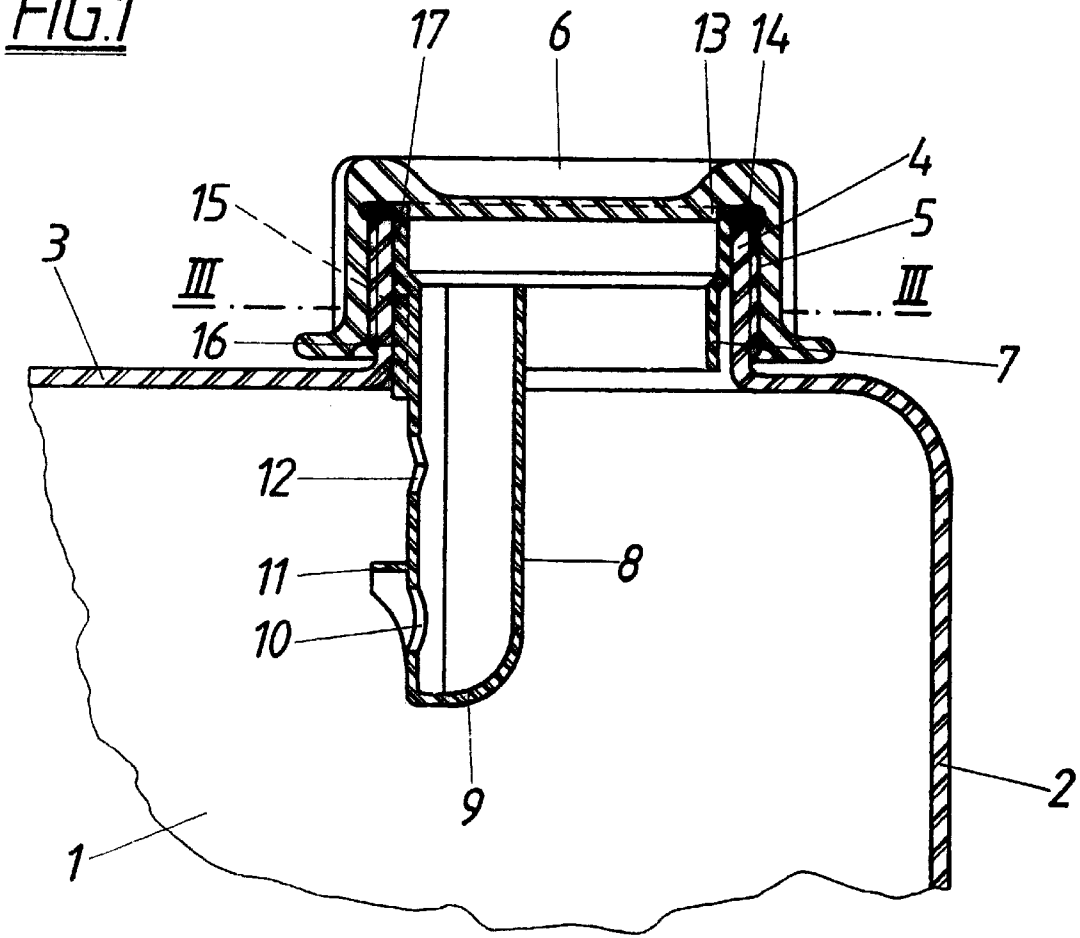
Figure 4:
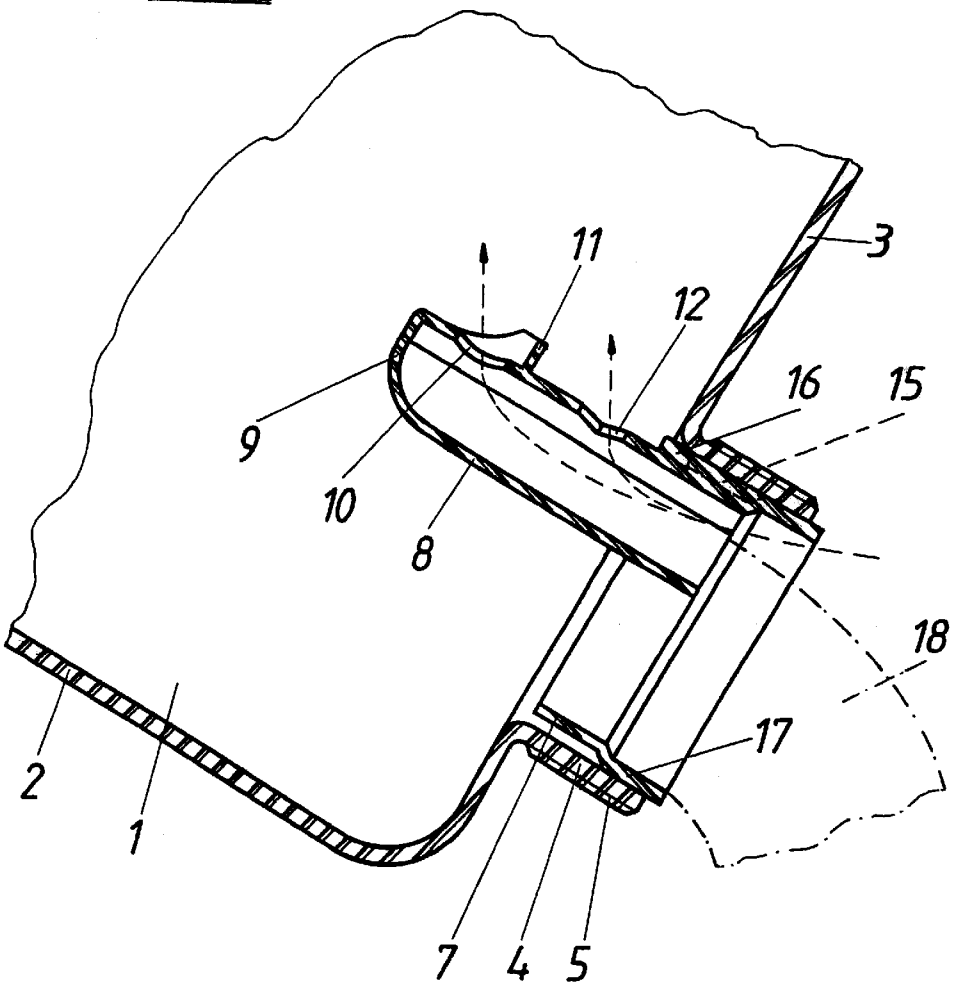
Figure 3:
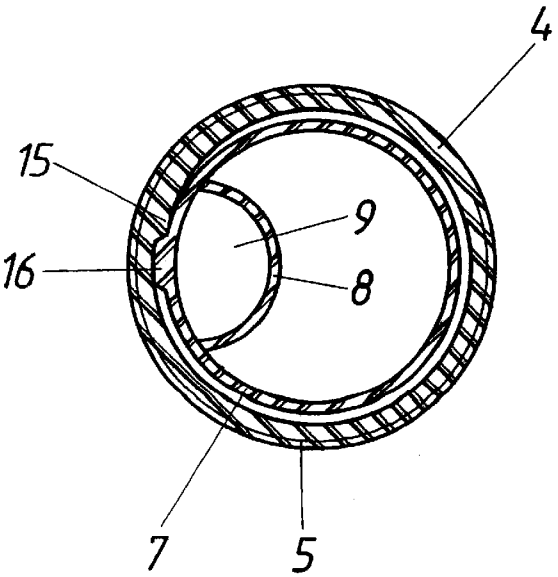

The inventive object is illustrated by way of example in the diagrams, in which:

FIG. 1 shows a pouring device according to the present invention in a simplified axial section, FIG. 2 shows this pouring device in a front view of the sealed end of the aeration pipe, FIG. 3 shows a section along line III—III of FIG. 1 with the sealing cap removed, and FIG. 4 shows the pouring device with the canister-shaped container in the pouring position.

BEST EXECUTION OF THE INVENTION

According to the illustrated embodiment canister-shaped container 1, not illustrated in greater detail here, exhibits a pouring spout 4 connecting to a front wall 2 in the vicinity of a cover wall 3 and having an external thread 5 for a screw-on sealing cap 6. Pressed fluid-tight into said pouring spout 4 is a retaining ring 7 to which an aeration pipe 8 connects, and indeed in an upper peripheral section of retaining ring 7 relative to the pouring position illustrated in FIG. 4. Aeration pipe 8 open towards retaining ring 7 and sealed at its end 9 averted from retaining ring 7 exhibits in the vicinity of sealed end 9 in the upper peak region relative to the pouring position a through opening 10 terminating in the container, which is partly enclosed by a deflecting baffle 11 on the side facing retaining ring 7. Said deflecting baffle 11 falls away towards sealed end 9 of aeration pipe 8. Provided between through opening 10, whose through cross-section is smaller than the flow cross-section of aeration pipe 8, and retaining ring 7 is another through opening 12 having a smaller still through cross-section.

For setting aeration pipe 8 in pouring spout 4 retaining ring 7 forms a pre-assembled structural unit along with sealing cap 6, in that retaining ring 7 is clamped in the floor of sealing cap 6 between an annular projection 13 and an annular seal 14. Sealing cap 6 can thus be screwed onto pouring spout 4 as aeration pipe 8 is inserted into pouring spout 4. Since according to FIG. 3 retaining ring 7 exhibits a limit stop 16 as rotating safety device cooperating with a counterstop 15 of pouring spout 4 retaining ring 7 is rotated into the position for use determined by stops 15 and 16 before retaining ring 7 is pressed into pouring spout 4, as sealing cap 6 is screwed onto pouring spout 4. Pouring spout 4 thus forms an expanded clamping collar 17 which engages in pouring spout 4 when the position for use for retaining ring 7 is reached with stops 15 and 16 in the stop position. After retaining ring 7 is inserted into pouring spout 4 if sealing cap 6 is unscrewed therefrom, the clamp connection between retaining ring 7 and sealing cap 6 is broken so that retaining ring 7 remains in pouring spout 4 with aeration pipe 8.

Container 1 is tipped to pour out the container fluid, as illustrated in FIG. 4. in the process an even pouring stream 18 is formed which allows container 1 to be continually emptied. This is enabled by aeration pipe 8 sealed at one end and through which the air can flow to equalise the pressure in container 1. This intake air entering via through openings 10 and 12 cannot be disrupted by the fluid stream on account of closed aeration pipe 8, with the exception of said through openings 10 and 12, such that extensively even pressure equalisation is set by the metered external air, as is indicated by the dashed direction arrows for this air. Matching of the cross-section of aeration pipe 8 and through openings 10 and 12 to one another supports the pressure equalisation, which requires an equalising air flow dependent on the pouring rate, required for an even pouring stream at the same time deflecting baffle 11 ensures particularly favourable flow conditions.

What is claimed is:

1. Pouring device for a canister-shaped container having a pouring spout which can be sealed by a sealing cap and which receives a retaining ring for an aeration pipe running at least approximately parallel to the retaining ring, which is set thereon in the upper peripheral section of the retaining ring relative to the pouring position, characterised in that the aeration pipe (8) is closed at its end (9) averted from the retaining ring (7) and in the vicinity of its upper peripheral section in the pouring position exhibits at least one through opening (10) terminating in the container (1) having a smaller through cross-section than the internal pipe cross-section.

2. Pouring device as claimed in claim 1, characterised in that provided on the outer periphery of the aeration pipe (8) on the side of the through opening (10) facing the retaining ring (7) is a deflecting baffle (11).

3. Pouring device as claimed in claim 2 characterised in that the deflecting baffle (11) falls away towards the sealed end (9) of the aeration pipe (8).

4. Pouring device as claimed in claim 1, characterised in that at least one more through opening (12) having a smaller through cross-section is provided between the through opening (10) arranged in the vicinity of the sealed end (9) of the aeration pipe (8) and the pouring spout (4) of the container (1).

5. Pouring device as claimed in claim 1, characterised in that a rotating safety device formed by limit stops (15, 16) is provided between the retaining ring (7) and the pouring spout (4) of the container (1).

6. Pouring device as claimed in claim 1, characterised in that the sealing cap (6) forms an assembly unit with the retaining ring (7) bearing the aeration pipe (8) able to be inserted positively into the sealing cap (6).

* * * * *